United States Patent [19]

Shacklock

[11] 4,216,663

[45] Aug. 12, 1980

[54] ROTATABLE LAUNDRY MACHINE DRUM

[75] Inventor: Frank W. Shacklock, Auckland, New Zealand

[73] Assignee: Fisher & Paykel Limited, Auckland, Netherlands

[21] Appl. No.: 953,402

[22] Filed: Oct. 23, 1978

[30] Foreign Application Priority Data

Oct. 25, 1977 [NZ] New Zealand ..... 185505

[51] Int. Cl.[2] ..... D06F 39/00

[52] U.S. Cl. ..... 68/3 R; 34/139; 68/23 R; 113/120 C; 220/66; 220/74; 428/595; 428/604

[58] Field of Search ..... 220/66, 73, 74; 72/379; 113/116 B, 116 D, 120 C, 120 W; 68/3 R, 23 R, 23.6, 23.7, 24, 133, 140, 174, 212, 232, 233; 34/133, 139; 428/595, 603, 604

[56] References Cited

U.S. PATENT DOCUMENTS

| | | | |
|---|---|---|---|
| 1,213,564 | 1/1917 | Williams | 113/116 D |
| 2,191,607 | 2/1940 | Chamberlin et al. | 68/140 X |
| 3,664,000 | 5/1972 | LeJeune | 113/116 D X |

FOREIGN PATENT DOCUMENTS 9240 2/1956 Fed. Rep. of Germany .

*Primary Examiner*—Philip R. Coe
*Attorney, Agent, or Firm*—Holman & Stern

[57] ABSTRACT

Curved inwardly flanged members in the form of cylinders (1) or conical frusta have the flange (2) thereof formed by folding sheet material (24) about a plurality of fold lines (3,10) to form corrugations or castellations having sides (6) of triangular formation and diverging first frusta segments (11) and second frusta segments (4,16) lying on two diverging conical frusta or short height relative to diameter. Such cylinders and frusta have hubs (25,58) and comprise rotating drums suitable for laundry machines such as clothes washing machines and clothes driers.

5 Claims, 9 Drawing Figures

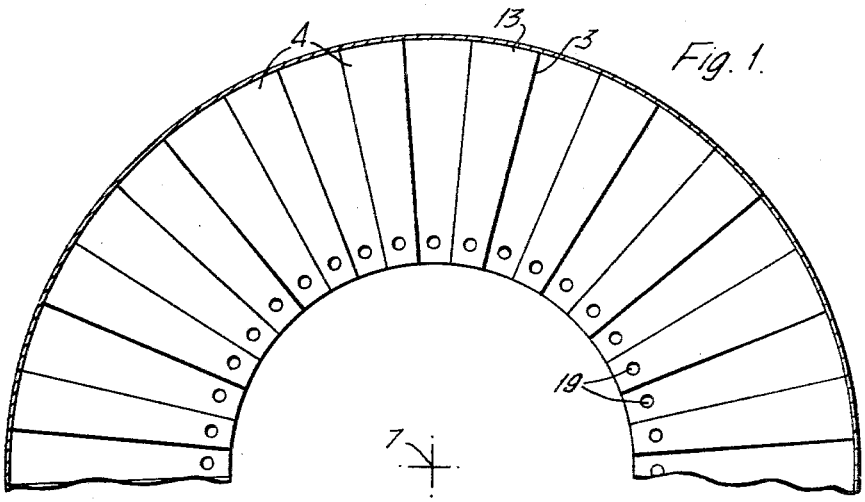
Fig. 1.
Fig. 2.
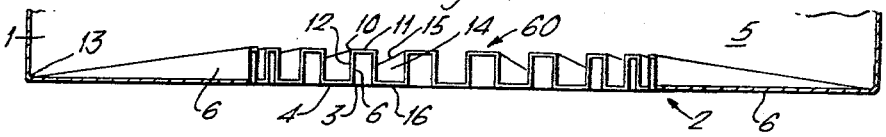
Fig. 3.
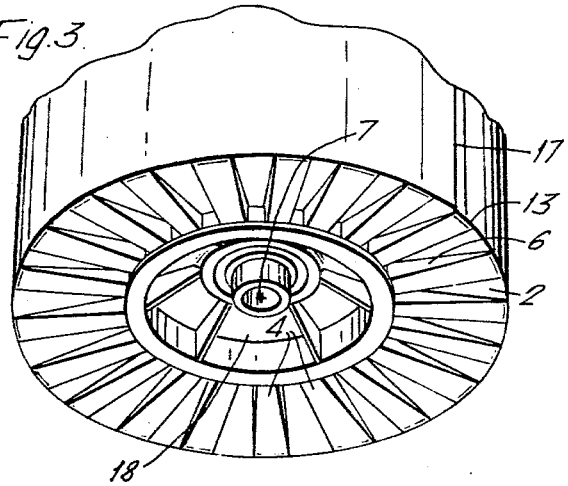

ROTATABLE LAUNDRY MACHINE DRUM

BRIEF SUMMARY OF THE INVENTION

This invention relates to inwardly flanged curved members and has been devised particularly though not solely in relation to inwardly flanged cylinders or conical frusta as parts of drums for clothes washing machines or driers.

It is an object of the present invention to provide inwardly flanged curved members which will at least provide the public with a useful choice. Accordingly in one aspect the invention consists in an inwardly flanged curved member formed from sheet material and having an inwardly directed flange on at least one end thereof said flange having triangular webs alternating with frusta segments, the alternate frustum segments lying on two different frusta diverging from the flange curved member with the apices of the triangular webs lying on a fold line common to the parent curved member and said frustum segments.

In a still further aspect the invention consists in an inwardly flanged curved member formed from sheet material into a cylinder or frustum of a cone having an inwardly directed flange on at least one end thereof said flange being formed by a series of fold lines with substantially triangular webs between first and second fold lines in one set of adjacent fold lines and adjacent sets of fold lines being separated by a short distance to form frustum segments lying in two different frusta, the apices of said triangular webs lying on a further fold line common to the parent wall and said first fold lines lying on one frustum and said second fold lines lying on a second frustum the outer edges of said two different frusta being separated by the bases of said triangular webs.

In a still further aspect the invention consists in an inwardly flanged curved member formed from sheet material into a cylinder or frustum of a cone having an inwardly directed flange on at least one end thereof, said flange being formed into a series of corrugations or castellations with two adjacent castellations one having a frustum segment forming a bottom surface, the other a frustum segment forming a top surface and the bottom and top surface being separated by a side surface, the side surface being connected to the bottom and top surfaces by fold lines which diverge from each other as the distance from the parent cylinder or frustum of a cone increases.

In a still further aspect the invention consists in a rotatable member comprising the combination of a flanged curved member in the form of a cylinder or a frustum according to any one of the preceding paragraphs and a hub fixed to said flange by fixing means which engage at least some of said frustum segments of each of said two different frusta.

In a still further aspect the invention consists in a laundry appliance such as a clothes washing machine and a clothes drier having a drum including a rotatable member according to the preceding paragraph.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

DETAILED DESCRIPTION OF THE SEVERAL VIEWS OF THE DRAWING

Figure 4:
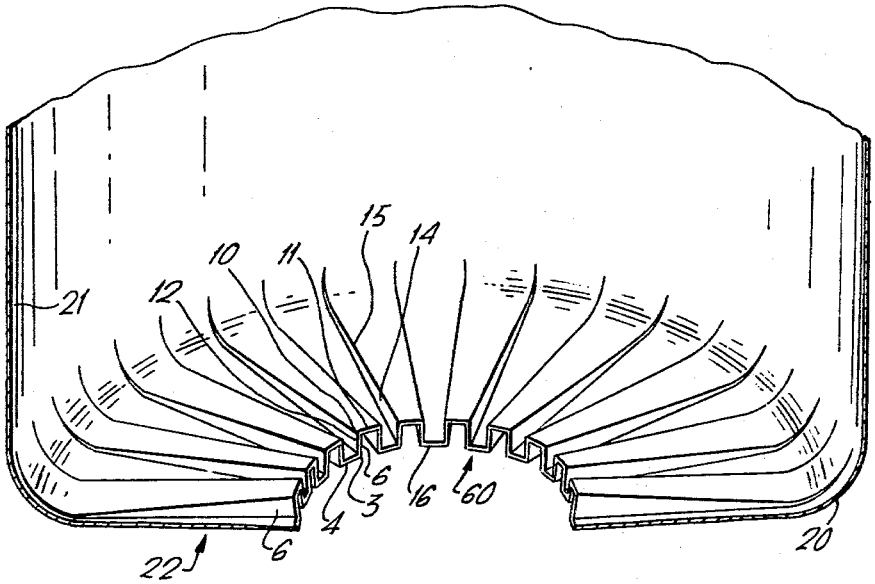
Figure 5:
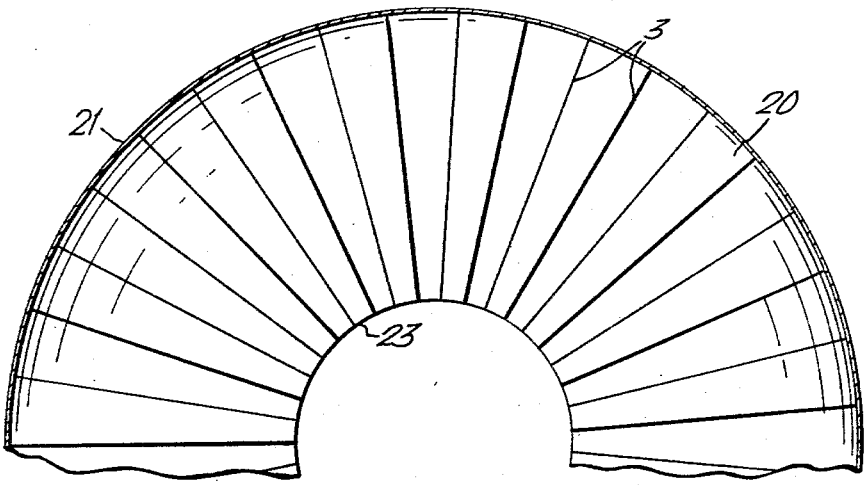
Figure 6:
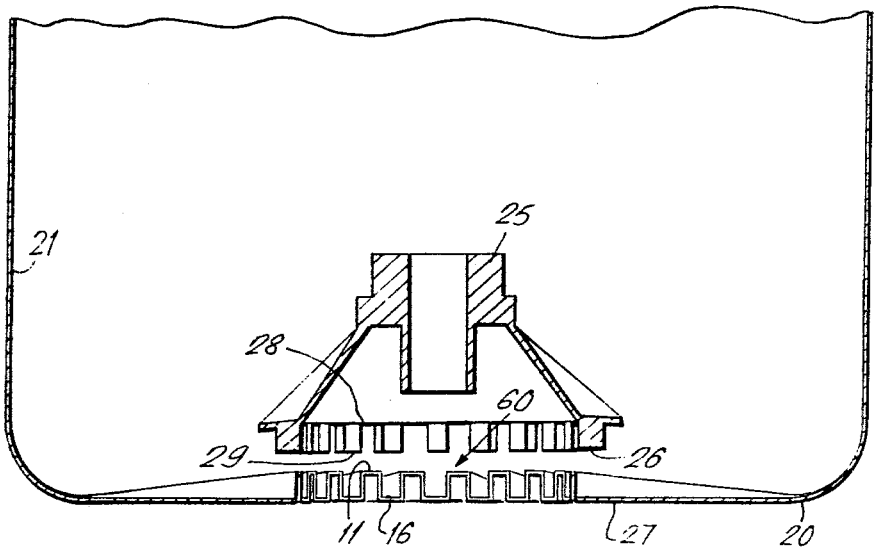
Figure 9:
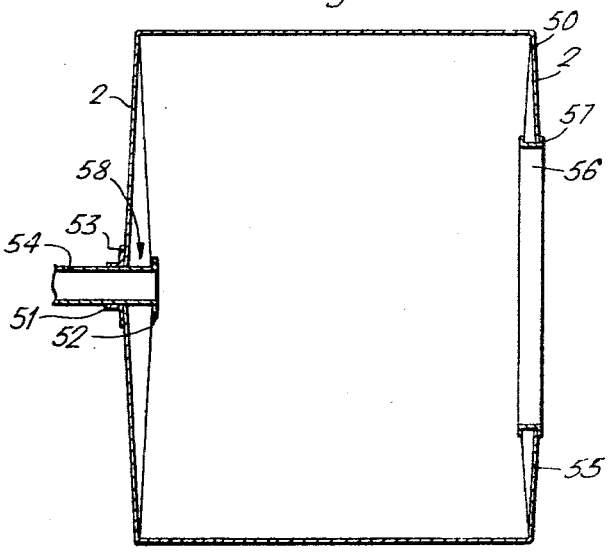
Figure 7:
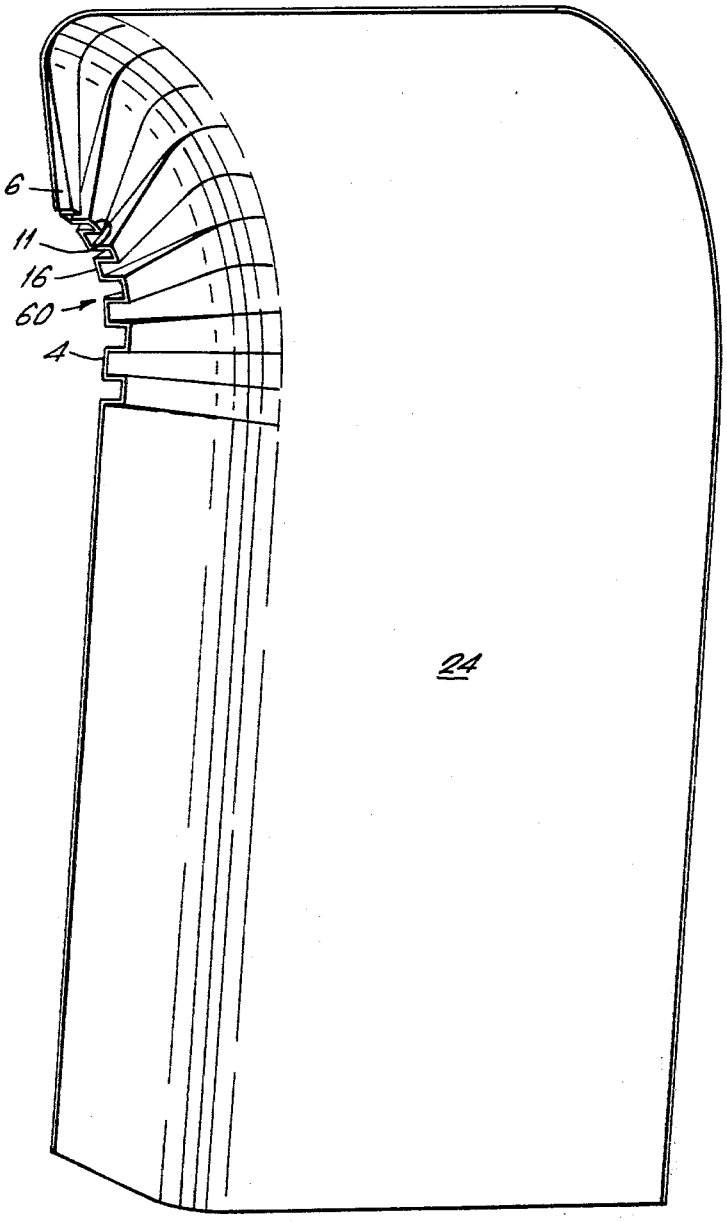
Figure 8:
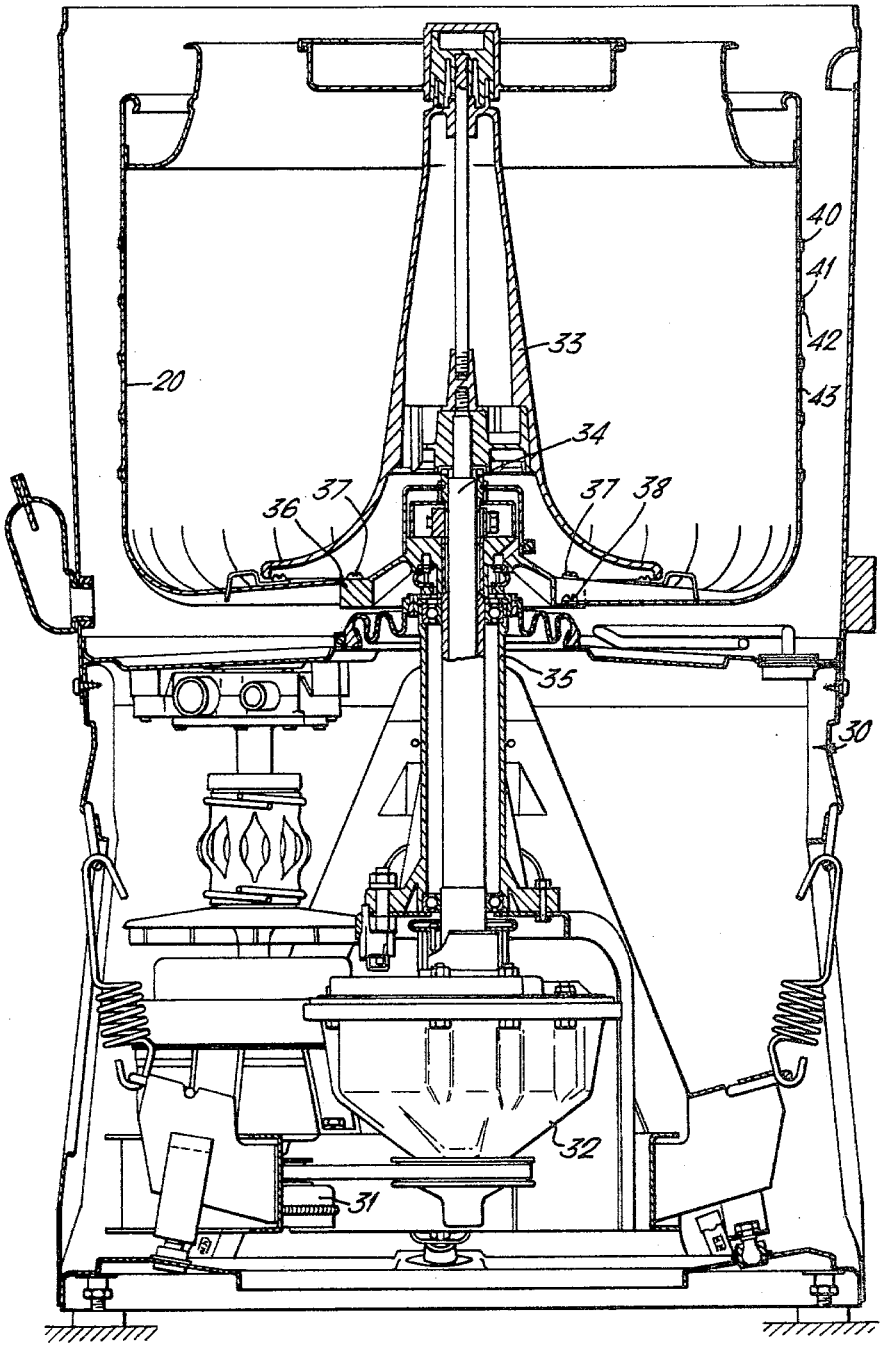

One preferred form of the invention will now be described with reference to the accompanying drawings in which:

FIG. 1 is a plan view of an inwardly flanged curved member according to the invention, FIG. 2 is a cross-section of the construction shown in FIG. 1, FIG. 3 is a perspective view of a clothes washing drum incorporating the flanged cylinder of FIGS. 1 and 2, FIG. 4 is a perspective sketch of a lower part of the drum of FIG. 3, FIG. 5 is a plan view of the drum of FIG. 4, FIG. 6 is a cross-section of the drum of FIGS. 4 and 5 including a hub within it but removed from engagement with the flange, FIG. 7 is a sketch of a sheet partly formed into a cylinder and flange according to the invention, FIG. 8 is a cross-sectional elevation of a clothes washing machine incorporating a drum or tub according to the invention, and FIG. 9 is a sketch of a clothes drying drum according to the invention.

DETAILED DESCRIPTION

Referring to FIGS. 1 to 3 of the drawings a curved member in the form of a cylinder 1 is formed having an inwardly directed flange 2 from a sheet of material such as a sheet of stainless steel. The forming of the flange 2 is effected by folding part of the sheet material (the flange material) about fold lines so that little or no stretching or compression of the material results as follows. Commencing with the radial fold line 3 a lower portion of the material of the flange referenced 4 as a result of the folding is turned in the plane substantially at right angles to that of the sheet material forming the wall 5 of the cylinder. An adjacent surface 6 is turned at right angles to the first surface 4. The fold line 3 is arranged to lie on a radius from a centre 7. A next fold line 10 is between the surface 6 and a second surface 11, the second surface 11 being substantially parallel to the surface 4 but displaced therefrom. As may be seen in FIG. 3 the surface 6 is of triangular formation tapering from a base length 12 as seen in FIG. 2 to a minimum length (practically zero) adjacent the junction 13 between the cylinder and the flange. A further triangular surface 14 is provided between the fold line 15 and a fold line between surface 14 and surface 16, the surface 16 being in the same plane as surface 4 and this pattern is continued around the periphery of the flange until the whole of the flange has been formed. The ends 17 (FIG. 3) of the cylinder 5 are then joined together by lock seaming, spot welding or otherwise as desired. The ends of the flange material need not be joined since bolting to a hub will effectively lock the flange ends in position, particularly if the ends are overlapped and bolt holes made near each end through which a hub bolt is inserted and fastened. A hub 18 is then fitted to appropriate ones of the surfaces 4 and 11 formed by the above fold lines being fixed by welding or stainless iron fasteners such as rivets or bolts and nuts, parts of which pass through the apertures 19 and through corresponding apertures in the hub 18 and parts of which such as the heads of the bolts and the nuts hold the surfaces 4 and 11 to the hub 18.

It will be seen that the flanging is formed by bending the flange material about fold lines first in one direction then in that same direction, then in the opposite direction and then again in the latter direction. The folding has the result that the peripheral length of any circumference of the flange is substantially constant and this peripheral length is in the form of corrugations or castellations 60. Preferably the transitions between cylindrical and conical parts have substantial radii, e.g. 40–50 mm. This may be effected either by providing a twisting action between members which hold the material on either side of a fold line in a manner such that each fold line is formed substantially independently of any other fold line or alternatively a series of fold lines are formed substantially simultaneously. The folding may be effected either by an individual tool having two members with a gap therebetween two such tools being side by side and turned relative to each other in the required direction or by a single tool, the rigidity of the material supplying the reaction force against the turning of the single tool or by a series, for example, a pair of interengaging wheels having two forms corresponding to the shape of the ribs 22 or by an operation in which the flanged material is pressed by one former over another shaped former to give the desired result.

The above construction refers to a cylinder having a sharp bend or square corner between the cylinder and the flange. In FIGS. 4 and 5 there is shown a part cylinder and flange arrangement in which there is a curved portion 20 between the cylindrical wall 21 and the flange generally shown at 22. However, the flange is formed in the same way as above described and the same reference numbers have been used in FIG. 4. In FIG. 5 it can be seen that the radial lines 3 extend from the inner edge 23 of the castellations or corrugations made according to the invention.

In FIG. 6 the cylinder and flange of FIGS. 4 and 5 is shown in cross-section and inside the cylinder is a hub 25 having castellations 26 which in use engage the castellations of the flange 27. It will be seen that the surface 28 of the hub 25 may be fixed to the surface 11 of the flange and the surface 29 fixed to the surface 16. Thus, the hub is fixed to the flange in two planes giving considerable increase in strength as compared with existing constructions which use only a single plane of fixing. The hub may be made of any suitable material, for example, may be a die casting.

In FIG. 7 there is shown a blank 24 in which the castellations are formed in a part thereof and the blank 24 thus has a portion which has been curved by a suitable operation before the castellating operation is commenced.

Referring now to FIG. 8 that figure shows a laundry appliance 30 in the form of a clothes washing machine in cross-section containing an electric motor 31, a drive mechanism 32 driving an agitator 33 through a shaft 34 and having a tube 35 which drives a hub 36 on which is mounted the drum or tub 20. Again the flange 2 of the drum 20 is fastened to the hub 36 in two planes by screws 37 and 38 again giving the desired effect.

It is to be noted that the drum 20 is provided with apertures, for example, apertures 40 comprising pieces of metal which are cracked out from the parent metal to leave a gap between the expanded piece of metal and the parent metal while the expanded piece of metal is still retained by the members 41 and 42 to the parent metal 43.

Thus, the openings are provided in the cylinder by making two parallel cuts and stretching the metal between the cuts so that a loop is formed, the ends of the loop being still integral with the parent metal so that the openings are provided between the edges of each stretched piece of metal and the parent metal.

The drum 50 shown in FIG. 9 is, for example, a rotatable member for use as a drum of a clothes drying machine such as that described in British Pat. No.1,221,343. The flange 51 formed as above described is fixed to flanges 52 and 53 which form a hub 58 by pop rivets, spot welding or bolts. It is to be noted that flange 52 is on tubular shaft 54 and flange 53 is on a collar 55 fixed to the shaft 54. It will be noted that the hub fixing to the flange is in two planes. The flange 55 also formed as above described surrounds an opening 56 which is defined by a channel cross-section ring 57 of, for example, a suitable plastics material.

It will be seen that in at least one of the preferred forms the above construction results in the formation of a flanged cylinder or frustum of a cone (or for that matter a cone in which an inwardly directed flange is formed by folding metal rather than by stretching it as is effected in a drawing operation. The drawing operation has the disadvantage that the metal of the drawn flange is thinned at points where it is desirable to have increased strength rather than reduced strength.

It will be seen also that the resulting flange is of considerable strength in that the surfaces 11 of the adjacent ribs lie on the surface of a conical frustum having a low height relative to its width and the surfaces 4 lie on a similar conical frustum but which is inverted relative to the frustum on which the surfaces 11 lie. Again, this gives an increase in strength in a desirable manner, particularly when used to fix the drum to a hub as described.

The flanged cylinder made as above described is preferably provided as an outer or preferably inner container for a clothes washing machine, the inner container being lined with, for example, a liner of a plastics material.

The invention also enables inwardly flanged drums or tubs to be made of, for example, stainless steel without the necessity for using expensive deep drawing quality metal.

Again, because of the absence of the thinning which is normally present when deep drawing is necessary a thinner gauge metal may be used. Also, since folding and preferably consecutive folding operations are used, the power (and therefore size of the equipment) and energy requirements are less than with deep drawing, resulting in savings in running and capital costs.

I claim:

1. A rotatable drum for a laundry machine comprising a cylindrical member formed from rectangular shaped sheet material attached at the ends thereof, a radially inwardly directed flange integrally formed on at least one end of said cylindrical member and having a width substantially less than the length of the cylindrical member, said flange having a castellated shape at its inner edge by having triangular webs alternating with frusta segments, the alternate frustum segments lying on two different frusta diverging from the outer edge of said flange at the cylindrical surface of said cylindrical member with the apices of the triangular webs lying on a fold line common to said cylindrical surface and said frustum segments.

2. A rotatable drum for a laundry machine comprising a cylindrical member formed from sheet material and open at the ends, a radially inwardly directed flange integrally formed on at least one of said ends, said flange having a width substantially less than the length of the cylindrical member and having a corrugated cross-sectional shape formed by a series of fold lines with substantially triangular webs between first and second fold lines in one set of adjacent fold lines and adjacent sets of fold lines being separated by a short distance to form frustum segments lying in two different frusta, the apices of said triangular webs lying on a further fold line common to the cylindrical surface of said cylindrical member and said first fold lines lying on one frustum and said second fold lines lying on a second frustum, the inner edges of said two different frusta being separated by the bases of said triangular webs.

3. A rotatable drum for a laundry machine comprising a cylindrical member formed from sheet material, said cylindrical member having open ends, a radially inwardly directed flange on at least one of said ends having a width substantially less than the length of the cylindrical member, said flange having a cross-sectional shape of a series of corrugations, adjacent pairs of corrugations providing one frustum segment forming a bottom surface and a second frustum segment forming a top surface, said bottom and top surfaces being separated by a side surface, the side surface being connected to the bottom and top surfaces by fold lines which diverge from each other in the radially inward direction.

4. A rotatable drum for a laundry machine as claimed in any one of the preceding claims and further comprising a hub fixed to said flange by fixing means which engage at least some of said frustum segments of each of said two different frusta.

5. A rotatable drum for a laundry machine as claimed in claim 4 wherein the cylindrical surface of said cylindrical member is provided with a series of apertures therein, each aperture comprised by two parallel slits of equal length through said cylindrical surface, the strip of material between the slits being expanded radially outwardly to form a loop fixed at each end to said cylindrical surface.

* * * * *